United States Patent [19]

Bevan et al.

[11] 4,088,610

[45] May 9, 1978

[54] DETERGENT COMPOSITIONS

[75] Inventors: Geoffrey Bevan; Peter Carter, both of Wirral, England

[73] Assignee: Lever Brothers Company, New York, N.Y.

[21] Appl. No.: 639,499

[22] Filed: Dec. 10, 1975

Related U.S. Application Data

[63] Continuation of Ser. No. 375,269, Jun. 29, 1973, abandoned.

[30] Foreign Application Priority Data

Jul. 12, 1972 United Kingdom ..... 32651/72

[51] Int. Cl.[2] ..... C11D 3/26; C11D 7/32

[52] U.S. Cl. ..... 252/541; 252/8.8; 252/8.9; 252/544; 252/548; 252/DIG. 2; 252/DIG. 15; 260/29.2 N

[58] Field of Search ..... 252/541, 544, 548, 8.8, 252/8.9, DIG. 2, DIG. 15; 260/29.2 N

[56] References Cited

U.S. PATENT DOCUMENTS 3,712,873 1/1973 Zenk ..... 252/8.9 X

FOREIGN PATENT DOCUMENTS 1,154,730 6/1969 United Kingdom.

*Primary Examiner*—Mayer Weinblatt

*Attorney, Agent, or Firm*—Kenneth F. Dusyn; James J. Farrell; Melvin H. Kurtz

[57] ABSTRACT

The soil release properties of condensation products of dicarboxylic acids, polyoxyethylene glycols, and a cycloaliphatic lactam or aliphatic diamine or salts thereof with a dicarboxylic acid are particularly good on polyamide material when used in combination with specific ethoxylated alkyl phenols, ethoxylated alcohols or monoethanolamides.

4 Claims, No Drawings

DETERGENT COMPOSITIONS

This is a continuation, of application Ser. No. 375,269, filed June 29, 1973, now abandoned.

This invention relates to detergent compositions which are of particular value in the washing of polyamide-containing fabrics.

It is known that some fabrics made of synthetic materials present special problems in the removal of oil-based soils from their surface. Polyamide materials, for example those sold under the trade name "nylon", demonstrate this problem, alleviation of this problem will be referred to hereinafter as "soil-release".

Specific condensation produces of dicarboxylic acids, polyoxyethylene glycols, and a cycloaliphatic lactam or aliphatic diamine or salts thereof with a dicarboxylic acid are disclosed in UK patent specification No. 1,124,271, the disclosure of which is incorporated herein by reference, and proposed as textile treatment agents. The salts of hexamethylene diamine and adipic acid in the molar ratio of 1:1 (hereinafter referred to as a "nylon" salt) is an example of the salts which may be used in these condensation products. The applicants have found that these polymers can be used in combination with specific detergent active materials to provide particularly good soil-release properties on polyamide materials. These condensation products are obtained by reacting together (a) an aliphatic dicarboxylic acid, (b) a hydroxypolyoxy-alkylene compound containing at least one polyoxyalkylene chain consisting of a plurality of oxyalkylene radicals linked directly to one another and (c) a compound selected from aliphatic or cycloaliphatic amino acids or lactams, aliphatic or cycloaliphatic diamines or salts thereof with the dicarboxylic acid (a), and mixtures of the said amino acids or lactams and the said diamines or salts thereof, or by reacting together ester- or amide-forming derivatives of the reactants (a), (b) and (c).

When polyamide-containing fabrics are washed in liquors containing the mixtures of the invention the fabrics are modified so that oil containing stains subsequently formed on the fabric are more easily removed on subsequent washing. The invention provides detergent powders and liquids which will be used to form a wash liquor, as well as a wash liquor prepared in situ by the separate addition of the two components required to be present together.

The invention relates to detergent powder or liquid formulations containing from about 0.1% to about 5% of a condensation product as defined herein in combination with from about 0.5% to about 20% of a detergent active selected from the groups:

(a) ethoxylated alkyl phenols wherein the total alkyl substituents contain from 6 to 12 carbon atoms, and the ethylene oxide (EO) is present in the molar ratio from 6:1 to 25:1 with reference to the alkyl phenol;

(b) condensation products of from 5 to 30 (preferably 5 to 20) molar ratios of ethylene oxide with 1 molar ratio of a straight or branched chain aliphatic, unsaturated and saturated, alcohol containing from 10 to 16 (preferably 12 to 15) carbon atoms and $C_{18}$ (unsaturated), the use of branched chain stock with 18 and 20 carbon atoms is also possible;

(c) monoethanolamides having an alkyl chain of $C_{10}$ to $C_{14}$ condensed with from 3 to 25, preferably 5 to 15, EO units.

The invention also extends to laundering processes using these mixtures of polymer and specific detergent active.

The preferred nonionic actives are:

nonyl phenol condensed with from 7 to 12 EO units, $C_{13}$ secondary alcohols condensed with from 3 to 12 EO units, $C_{15}$ secondary alcohols condensed with from 5 to 15 EO units, and $C_{12}$ to $C_{14}$ primary alcohols condensed with from 8 to 15 EO units.

Detergent formulations of the invention may contain actives other than the active materials defined previously. The applicants have found that relatively small amounts of anionic actives can decrease the soil-release effect obtained by the practise of the present invention. For example, the applicants have found that the addition of up to 80%, preferably not more than 40% (by weight of the nonionic active) of dodecyl benzene sulphonate can be tolerated while still obtaining a useful technical effect. Large proportions of nonionic actives outside the definition can be tolerated. Other types of active outside the definition, for example nonionic, amphoteric or zwitterionic can be present in relatively large proportion without serious loss of the soil-release properties. Thus use of a mixture of nonionic actives, the mixture containing actives both within and outside the above definition will provide the soil-release properties of the invention.

The detergent compositions of the invention will contain the other required or optional components for example builder materials, examples of which are sodium tripolyphosphate, sodium orthophosphate, sodium carbonate, salts and esters of sulphonated fatty acids, salts of nitrilotriacetic acid, salts of ethylene diamine tetraacetic acid and phosphonate derivatives thereof, oxidised starches and polymeric builders for example polycarboxylates; other detergent active materials, silicate materials (which may be included as builder materials), antiredeposition agents for example sodium carboxymethyl-cellulose and polyvinylpyrollidone, fluorescers, germicides, enzymes, bleaches. The solid form of the composition will not be limited and any of the forms known in the field are available for example pellets, powders, flakes and extruded forms. The invention is also applicable to liquid compositions.

In a preferred solid formulation the copolymer is mixed with an organic extrudable solid to form granules. The technique used is that described in UK specification No. 1,204,123.

Examples of the composition of the invention will now be given. The following test method was used to evaluate the soil-release effect.

TEST METHOD

Approximately 8 g bulked polyamide fabric or lightweight knitted shirting fabric was treated by washing once in 1 liter of a wash liquor containing 0.05% of a detergent active from the defined range of surfactants and 0.10% sodium tripolyphosphate. The wash was carried out in the Terg-O-Tometer (United States Testing Co. Ltd. of Hoboken N.J.) both in the absence and presence of 0.0015% of polymer for 30 minutes at 50° C and a water hardness of 24° H with subsequent rinsing and drying.

Samples (~1.0 g) of the treated fabric were stained in a standard manner with approximately 0.035 g dirty sump oil. After ageing for approximately 15 minutes, two stained pieces were washed together once in the Terg-O-Tometer in 1 liter of the same surfactant system as in the pre-treatment for 10 minutes at 50° C and water hardness 24° H. Following rinsing and drying, the reflectances of the stains were measured using an Elrepho Reflectometer.

EXAMPLE 1

A sump oil soil-release test was performed on bulked polyamide fabric using the method described and using a polymer prepared from 2 moles adipic acid, 1 mole polyoxyethylene glycol (mol wt 2000) and caprolactam, the latter being present at a level of 35.4% by weight of the final polymer. The detergent active used was a nonyl phenol 8 EO and the level of polymer in the wash liquor 0.0015%. The reflectance of the sample washed in the presence of the polymeric additive was 77% indicating an excellent soil-release effect, whereas that in the absence of additive was 23.5%.

EXAMPLE 2

Example 1 was repeated using a polymer prepared from 2 moles adipic acid, 1 mole polyoxyethylene glycol (mol wt 1540), "nylon" salt at a level of 10% by weight of the total reactants, and caprolactam present at 42% by weight of the final polymer. A reflectance of 78% was recorded indicating an excellent soil-release effect.

EXAMPLE 3

Example 1 was repeated using nonyl phenol 12 EO as the detergent active. A reflectance of 78% was attained compared to a reflectance of 36% for fabric washed in the absence of polymeric additive.

EXAMPLE 4

Example 2 was repeated using nonyl phenol 12 EO as the detergent active. A reflectance of 79% was recorded.

Other Examples are quoted in Table I.

Table I

| Example | Polymer | Polymer Level % | Detergent Active | % Reflectance With Polymer | Control |
|---|---|---|---|---|---|
| 5 | As in Ex.1 | 0.0015 | $C_{15}$ secondary | 79.0 | 27.5 |
| 6 | As in Ex.2 | 0.0015 | " | 79.5 | 27.5 |
| 7 | As in Ex.1 | 0.0015 | $C_{15}$ secondary alcohol 9 EO | 79.5 | 26.5 |
| 8 | As in Ex.2 | 0.0015 | " | 81.0 | 26.5 |
| 8 | As in Ex.1 | 0.0015 | $C_{15}$ secondary alcohol 15 EO | 78.5 | 30.5 |
| 10 | As in Ex.2 | 0.0015 | " | 78.5 | 30.5 |
| 11 | As in Ex.1 | 0.0015 | $C_{14}$ secondary alcohol 9 EO | 80.0 | 30.5 |
| 12 | As in Ex.2 | 0.0015 | " | 80.0 | 30.5 |

EXAMPLE 13

Example 1 was repeated using sodium oleate as the detergent active. The fabric washed in the presence of polymeric additive gave a reflectance of 69%, whereas a reflectance of 33% was attained by the fabric washed in the absence of additive.

Examples which illustrate the deleterious effect of anionic surfactants other than soaps on soil-release properties are given in Table II.

Table II

| Example | Polymer | Polymer Level % | Surfactant Level % | Detergent Active | % Reflectance With Polymer | Control |
|---|---|---|---|---|---|---|
| 14 | As in Ex.2 | 0.0015 | 0.05% | $C_{15}$ secondary alcohol 9 EO | 80 | 28 |
| 15 | " | 0.0015 | 0.045 | $C_{15}$ secondary alcohol 9 EO | 76 | 24 |
| | | | 0.005 | Dodecyl benzene sulphonate | | |
| 16 | " | 0.0015 | 0.04 | $C_{15}$ secondary alcohol 9 EO | 61.5 | 25 |
| | | | 0.01 | Dodecyl benzene sulphonate | | |
| 17 | " | 0.0015 | 0.035 | $C_{15}$ secondary alcohol 9 EO | 40.5 | 28 |
| | | | 0.015 | Dodecyl benzene sulphonate | | |
| 18 | " | 0.0015 | 0.025 | $C_{15}$ secondary alcohol 9 EO | 36 | 34.5 |
| | | | 0.025 | Dodecyl benzene sulphonate | | |

EXAMPLE 19

A sump oil soil-release test was performed on lightweight knitted polyamide shirting fabric using the method described and using a polymer prepared by reacting 2 moles adipic acid, 1 mole polyoxyethylene glycol (mol wt 1000) and caprolactam, the latter being present at a level of 40% by weight of the final polymer. The detergent active used was a $C_{15}$ secondary alcohol 9 EO and the level of polymer in the wash liquor 0.003%. The reflectance of the fabric washed in the presence of the polymeric additive was 65.5% indicating a good soil-release effect, whereas that in the absence of additive was 42.5%.

EXAMPLE 20

Example 19 was repeated using a polymer prepared by reacting 2 moles adipic acid, 1 mole polyoxyethylene glycol (mol wt 1540), "nylon" salt at a level of 10% by weight of the total reactants, and caprolactam at a level of 42% by weight of the final polymer. A reflectance of 80% was attained indicating an excellent soil-release effect compared to 42.5% for the fabric washed in the absence of polymeric additive.

Other Examples as for Example 19 are quoted in Table III.

Table III

| Example | Adipic Acid Moles | Polyoxy-ethylene Glycol Moles | Mol wt Polyoxy-ethylene Glycol | Caprolactam % | Nylon Salt % | % Reflectance with Polymer | % Reflectance Without |
|---|---|---|---|---|---|---|---|
| 21 | 2 | 1 | 1000 | 61.5 | — | 62.5 | 42.5 |
| 22 | 2 | 1 | 1540 | 12.5 | — | 65 | 42.5 |
| 23 | 2 | 1 | 1540 | 35.5 | — | 71 | 42.5 |
| 24 | 2 | 1 | 1540 | 56 | — | 63 | 42.5 |
| 25 | 2 | 1 | 2000 | 20 | — | 76.5 | 42.5 |
| 26 | 2 | 1 | 2000 | 42.5 | — | 74.5 | 42.5 |
| 27 | 2 | 1 | 3000 | 25 | — | 76 | 42.5 |
| 28 | 2 | 1 | 3000 | 34.5 | — | 71 | 42.5 |
| 29 | 2 | 1 | 1540 | 15 | 30 | 80 | 42.5 |
| 30 | 2 | 1 | 1540 | 42 | 10 | 81 | 42.5 |
| 31 | 2 | 1 | 600 | 55 | — | 72 | 42.5 |
| 32 | 1 | 1 | 1540 | 53.5 | — | 63.5 | 42.5 |
| 33 | 3 | 1 | 1540 | 52.2 | — | 67.6 | 42.5 |
| 34 | 3 | 1 | 1000 | 55 | — | 64 | 42.5 |

The following nonionic actives are not included in the defined class.

| | Reflectance % With Polymer | Reflectance % Without |
|---|---|---|
| Hardened Tallow fatty acid 5 EO | 32 | 26.5 |
| Hardened Tallow fatty acid 20 EO | 33 | 30.5 |
| Hardened Tallow alcohol 10 EO | 34 | 26 |
| Hardened Tallow alcohol 18 EO | 35 | 26 |
| $C_{18}$ primary alcohol 5 EO | 32 | 26.5 |
| $C_{18}$ primary alcohol 18 EO | 35 | 28.5 |

What is claimed is:

1. A detergent powder or liquid composition consisting essentially of from about (A) 0.1% to about 5% by weight of a condensation product of (a) a dicarboxylic acid of the formula $HO_2C_nCO_2H$ in which $n$ represents zero or a positive integer from 1 to 10;

(b) a hydroxy-polyoxy-alkylene compound containing at least one polyalkylene chain consisting of a plurality of oxyalkylene radicals linked directly to one another whose alkylene groups contain from 2 to 4 carbon atoms; and (c) a compound selected from the group consisting of:

(i) an amino acid or lactam compound of the formulae $NH_{2n}CO_2H$ and wherein $n$ is a positive integer from 3 to 11, (ii) an aliphatic diamine, or salt thereof, of the formula $NH_{2m}NH_2$ in which $m$ is an integer of from 2 to 12, and (iii) a mixture of said lactam compound with said diamine compound or salts thereof; in combination with:

(B) from about 0.5 to about 20% by weight of a detergent active compound selected from the group consisting of:

(a) an ethoxylated alkyl phenol wherein the total alkyl substituent contains from 6 to 12 carbon atoms, and wherein the molar ratio of the ethylene oxide moiety to the alkyl phenol moiety is from about 6:1 to about 25:1, (b) a condensation product of ethylene oxide and (i) a straight or branched chain, aliphatic, unsaturated $C_{18}$ alcohol, or (ii) a straight or branched chain, aliphatic, saturated or unsaturated alcohol concontaining 10 to 16 carbon atoms, or (iii) a branched chain, aliphatic, unsaturated $C_{20}$ alcohol, the molar ratio of said ethylene oxide to said alcohol being about 5:1 to about 30:1; and (c) a monoethanolamide having an alkyl chain of 10 to 14 carbon atoms condensed with from 3 to 25 ethylene oxide units.

2. The detergent composition defined in claim 1 wherein the detergent active compound is selected from the group consisting of (a) nonyl phenol condensed with from 7 to 12 ethylene oxide units;

(b) a $C_{13}$ secondary alcohol condensed with from 3 to 12 ethylene oxide units;

(c) a $C_{15}$ secondary alcohol condensed with from 5 to 15 ethylene oxide units; and (d) a $C_{12}$ to $C_{14}$ primary alcohol condensed with from 8 to 15 ethylene oxide units.

3. The detergent composition defined in claim 1 wherein the alcohol defined in paragraph (B) (b) (ii) contains 12 to 15 carbon atoms.

4. The detergent composition defined in claim 1 wherein the alkyl chain defined in paragraph (B) (c) is condensed with from 5 to 15 ethylene oxide units.

* * * * *

UNITED STATES PATENT AND TRADEMARK OFFICE

CERTIFICATE OF CORRECTION

PATENT NO. : 4,088,610

DATED : May 9, 1978

INVENTOR(S) : Bevan et al

It is certified that error appears in the above-identified patent and that said Letters Patent are hereby corrected as shown below:

In the Claims

Column 5, line 43, change "$HO_2C_nCO_2H$" to --$HO_2C(CH_2)_nCO_2H$-- line 54, change "$NH_{2n}CO_2H$" to --$NH_2(CH_2)_nCO_2H$ and $\begin{pmatrix} (CH_2)_n \\ NH\text{-}CO \end{pmatrix}$ -- line 57, change "$NH_{2m}NH_2$" to --$NH_2(CH_2)_mNH_2$--

Signed and Sealed this

*Eighteenth* Day of *August 1981*

[SEAL]

*Attest:*

GERALD J. MOSSINGHOFF

*Attesting Officer*

*Commissioner of Patents and Trademarks*